US009660342B2

(12) United States Patent
Lin

(10) Patent No.: US 9,660,342 B2
(45) Date of Patent: May 23, 2017

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 148 days.

(21) Appl. No.: 14/463,900

(22) Filed: Aug. 20, 2014

(65) Prior Publication Data

US 2015/0054693 A1 Feb. 26, 2015

(30) Foreign Application Priority Data

Aug. 22, 2013 (CN) ..... 2013 1 0367165

(51) Int. Cl.
*H01Q 1/24* (2006.01)
*H01Q 5/371* (2015.01)
*H01Q 5/378* (2015.01)

(52) U.S. Cl.
CPC ..... *H01Q 5/371* (2015.01); *H01Q 1/243* (2013.01); *H01Q 5/378* (2015.01)

(58) Field of Classification Search
CPC ..... H01Q 1/243; H01Q 1/38; H01Q 9/0421
USPC ..... 343/702, 872, 878
See application file for complete search history.

(56) References Cited

U.S. PATENT DOCUMENTS 7,265,720 B1 * 9/2007 Ponce De Leon ..... H01Q 1/243 343/700 MS
2010/0045560 A1 * 2/2010 Sakuma ..... H01Q 1/38 343/793

* cited by examiner

*Primary Examiner* — Dameon E Levi
*Assistant Examiner* — Collin Dawkins
(74) *Attorney, Agent, or Firm* — Steven Reiss

(57) ABSTRACT

A wireless communication device includes a substrate and an antenna structure. The substrate includes a first surface and a second surface opposite the first surface. The antenna structure includes a feeding antenna, a metal ring, and a parasitic antenna. The feeding antenna has a feeding point configured to feed current signal. The metal ring is positioned apart from the feeding antenna, the metal ring is configured to be grounded and resonate with the feeding antenna to generate a first high-frequency resonate mode. The parasitic antenna is connected to the metal ring, the parasitic antenna is configured to resonate with the feeding antenna to generate a second high-frequency resonate mode, and resonate with the metal ring to generate a low-frequency mode.

19 Claims, 9 Drawing Sheets

ANTENNA STRUCTURE AND WIRELESS COMMUNICATION DEVICE EMPLOYING SAME

FIELD

The subject matter herein generally relates to antenna structure and wireless communication device employing same.

BACKGROUND

With improvements in the integration of wireless communication systems, broadband antennas have become increasingly important. For a wireless communication device to utilize various frequency bandwidths, antennas having wider bandwidths have become a significant technology.

BRIEF DESCRIPTION OF THE DRAWINGS

Implementations of the present technology will now be described, by way of example only, with reference to the attached figures.

DETAILED DESCRIPTION

Figure 1:
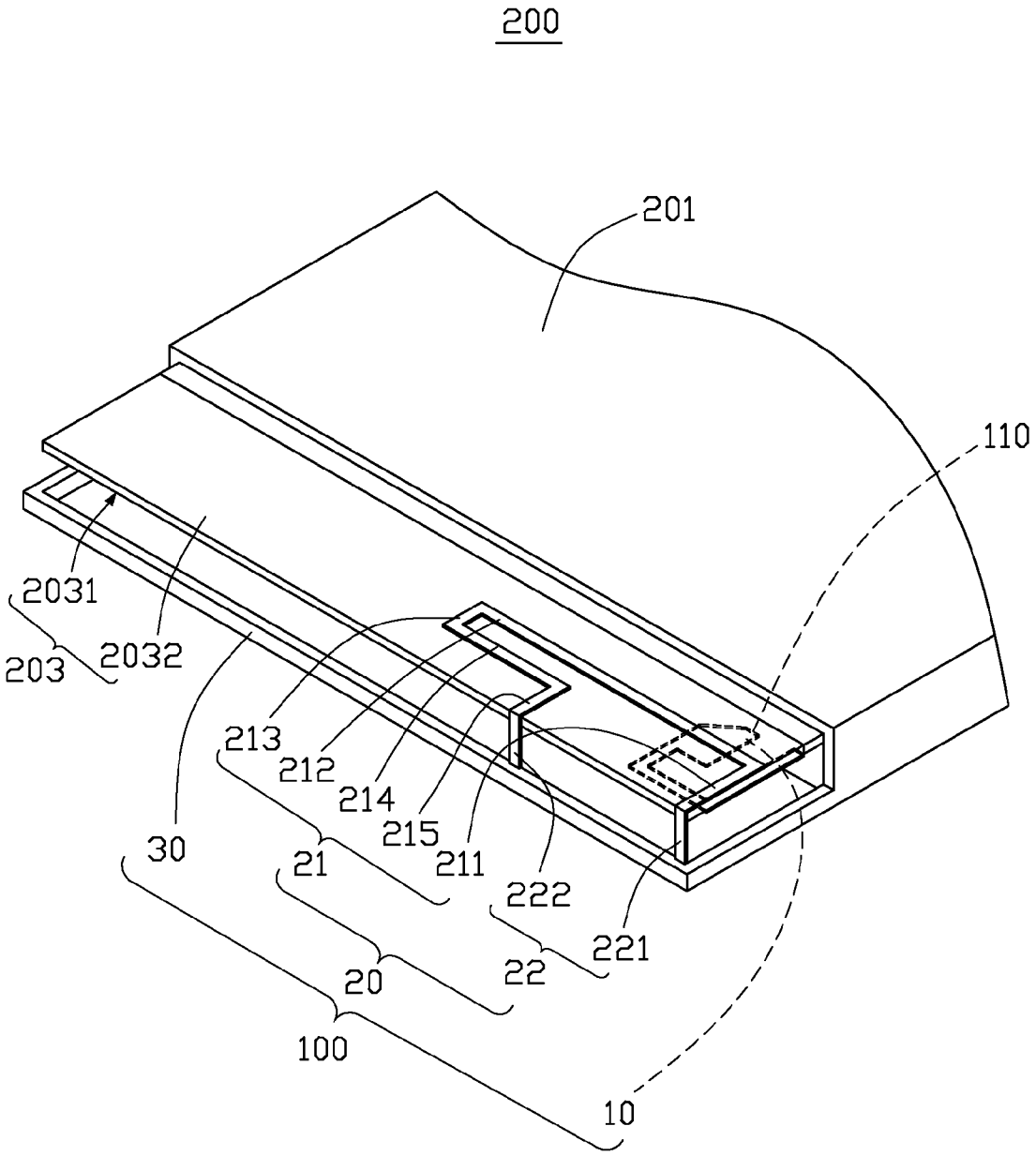
FIG. 1 is a partial isometric view of a first embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates a partially isometric view of a first embodiment of a wireless communication device 200 employing an antenna structure 100 and a substrate 203. The substrate 203 has a first surface 2031 and a second surface 2032 opposite to the first surface 2031. The antenna structure 100 includes a feeding antenna 10, a parasitic antenna 20, and a metal ring 30. The feeding antenna 10 is positioned on the first surface 2031, and has a feeding point 110 can feed current signal. The metal ring 30 is positioned apart from the feeding antenna 10, the metal ring 30 can be grounded and resonate with the feeding antenna 10 to generate a first high-frequency resonate mode. The parasitic antenna 20 is coupled to the metal ring 30 and positioned on the second surface 2032. The parasitic antenna 20 can resonate with the feeding antenna 10 to generate a second high-frequency resonate mode, and resonate with the metal ring 30 to generate a low-frequency resonate mode.

The wireless communication device 200 further includes a metal cover 201, the metal ring 30 is one part of the metal cover 201. In one embodiment, the metal ring 30 is positioned at one end of the metal cover 201.

As shown in FIG. 1, the parasitic antenna 20 includes a resonating portion 21 and a connecting portion 22. The resonating portion 21 is positioned on a first plane, that is, the second surface 2032 of the substrate 203; the connecting portion 22 is positioned in a second plane that is substantially perpendicular to the first plane. The connecting portion 22 connects the resonating portion 21 with the metal ring 30.

In particular, the resonating portion 21 includes five radiating arms 211-215 which are connected sequentially. The radiating arm 211 and the radiating arm 212 cooperatively define a first L-shape structure; the radiating arm 214 and the radiating arm 215 cooperatively define a second L-shape structure; the first L-shape structure and the second L-shape structure are positioned at a same side of the radiating arm 213.

The connecting portion 22 includes two connecting arms 221-222. The connecting arm 221 substantially perpendicularly extends from an end of the radiating arm 211. The connecting arm 222 substantially perpendicularly extends from an end of the radiating arm 215, and is parallel to the connecting arm 221.

Figure 2:
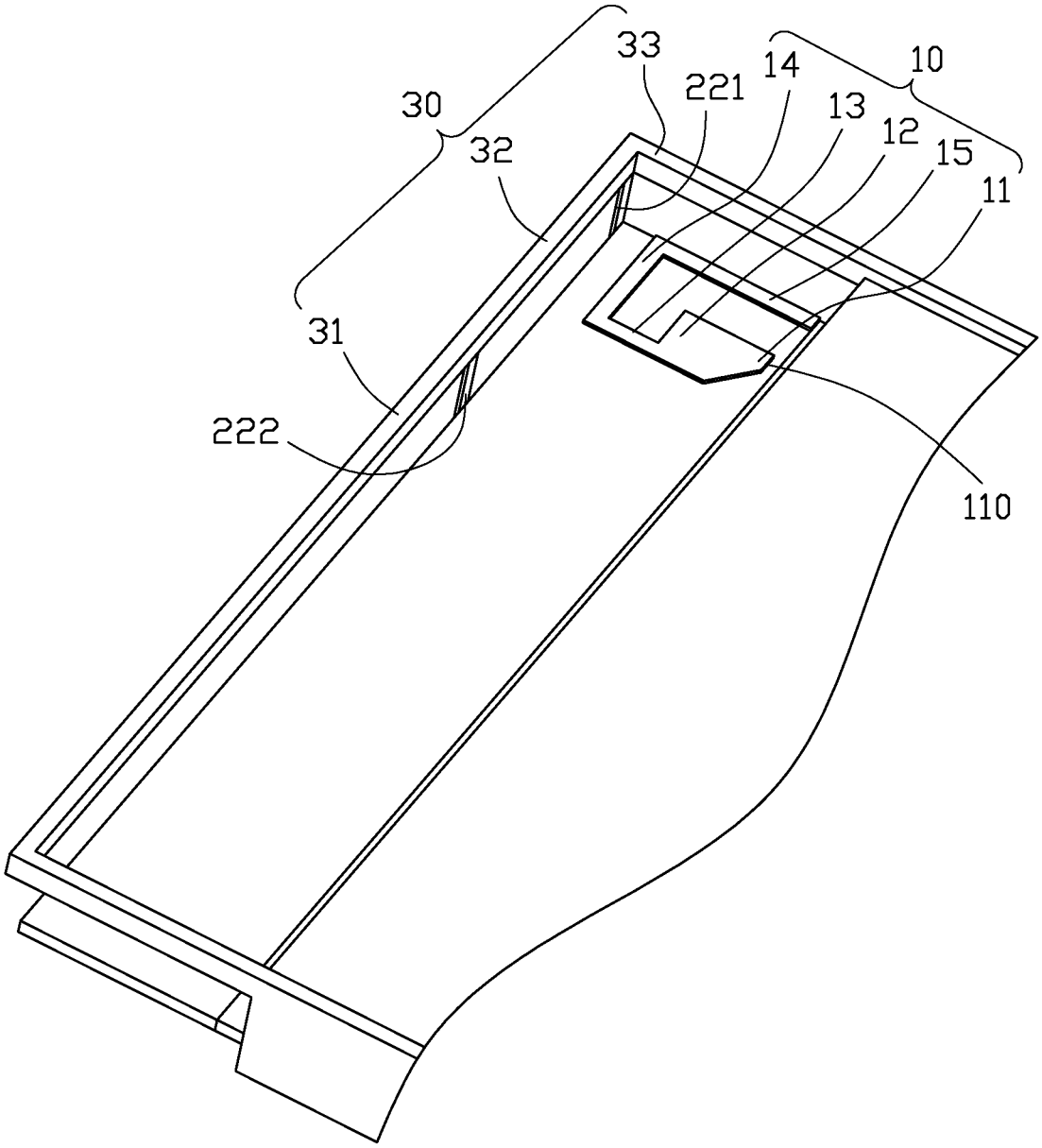
FIG. 2 is similar to FIG. 1, but shown the wireless communication device from another angle.

FIG. 2 is similar to FIG. 1, but shown the wireless communication device 200 from another angle. The metal ring 30 includes a first section 31, a second section 32, and a third section 33. The second section 32 continuously extends from the first section 31; the third section 33 substantially perpendicularly extends from the second section 32. A junction between the first section 31 and the second section 32 connects to an end of the connecting arm 221 (also see FIG. 1); a junction between the second section 32 and the third section 33 connects to an end of the connecting arm 222 (also see FIG. 1).

The feeding antenna 10 includes a first strip 11, a second strip 12, a third strip 13, a fourth strip 14, and a fifth strip 15, all of which are connected sequentially. The first strip 11 is substantially trapezoid-shaped. The second strip 12 is substantially rectangular shaped and continuously extends from the first strip 11. The third strip 13 substantially perpendicularly extends from one side of the second strip 12, and is narrower than the second strip 12. The fourth strip 14 substantially perpendicularly extends from the third strip 13; the fourth strip 14 and the fifth strip 15 cooperatively form an L-shape structure. The third strip 13 and the fifth strip 15 are positioned at a same side of the fourth strip 14. The feeding point 110 is defined at one side of the first strip 11 opposite the second strip 12.

Figure 3:
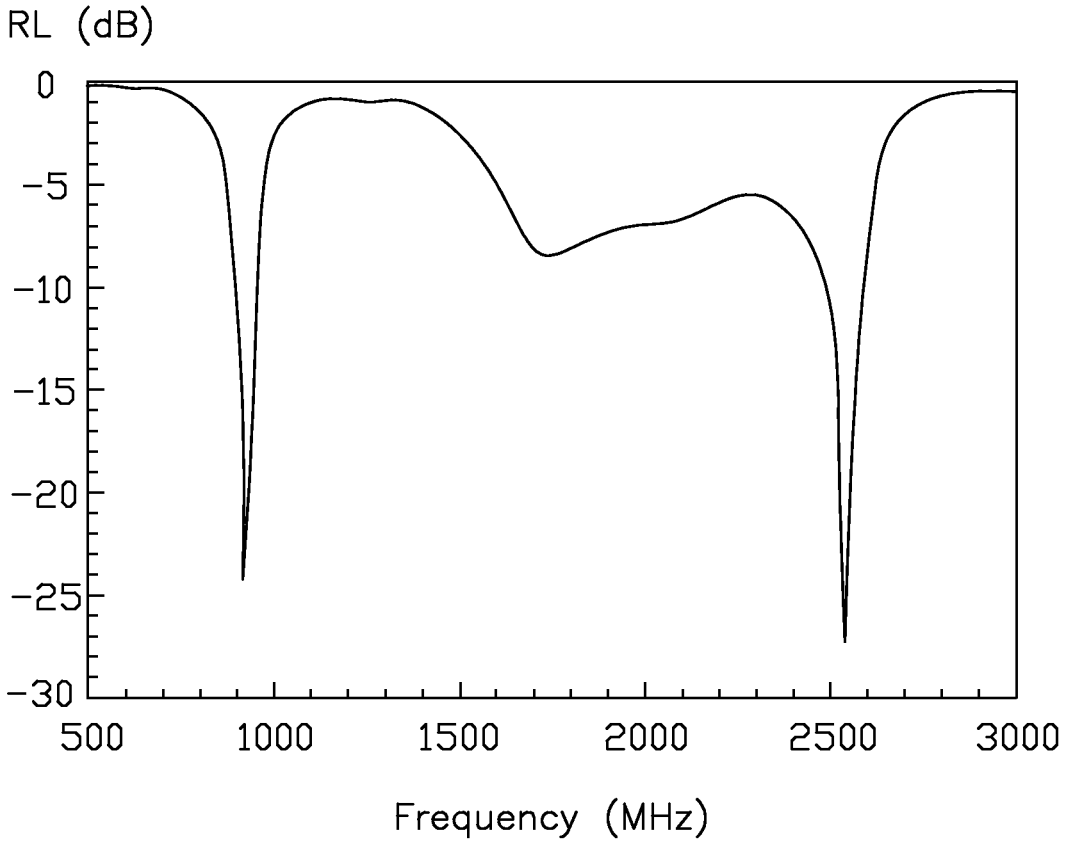
FIG. 3 is a diagram showing return loss ("RL") measurement of the antenna structure shown in FIG. 1.

FIG. 3 illustrates a diagram showing return loss ("RL") measurement of the antenna structure 100 shown in FIG. 1. In use, when a current signal is fed to the feeding point 110, the parasitic antenna 20 resonates with the metal ring 30 to generate the low-frequency resonate mode having a central frequency at about 920 MHz, the parasitic antenna 20 also resonate with the feeding antenna 10 to generate the second high-frequency resonate mode having a central frequency at about 1710 MHz. In addition, the metal ring 30 resonates with the feeding antenna 10 to generate the first high-frequency resonate mode having a central frequency at about 2530 MHz, such that the bandwidth of the antenna structure at high-frequency is broadened. Accordingly, the wireless communication device 200 employing the antenna structure 100 can be used in common wireless communication systems, such as GSM/DCS/PCS/WCDMA/LTE, with exceptional communication quality.

Figure 4:
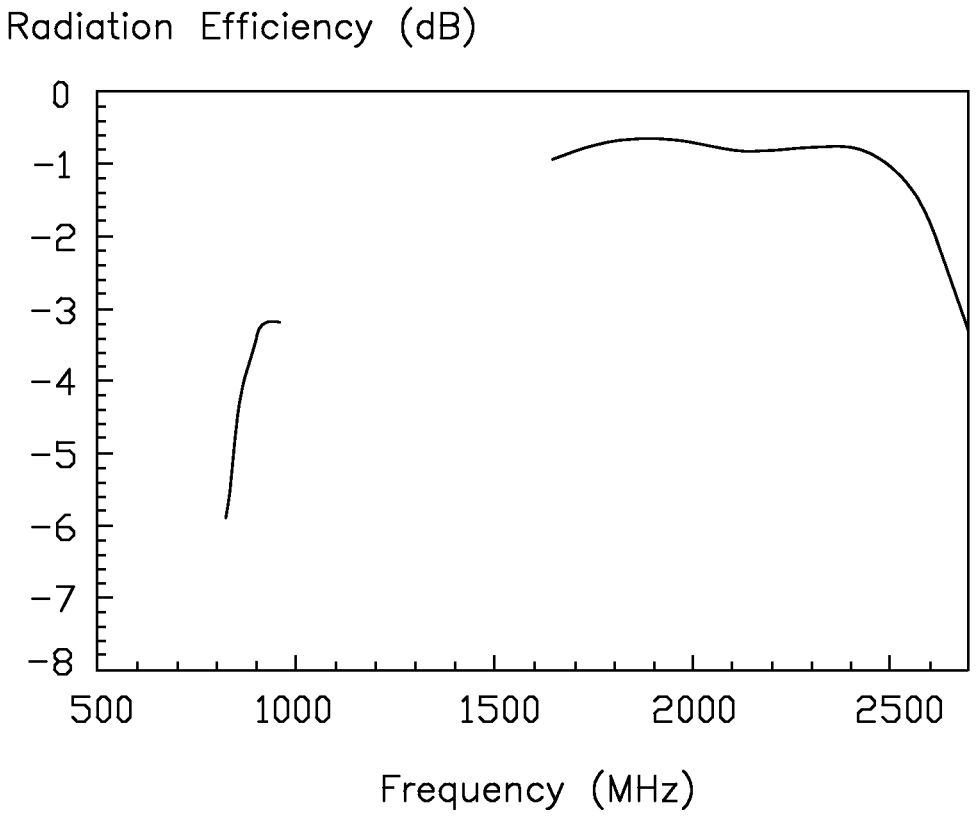
FIG. 4 is a diagram showing radiation efficiency measurement of the antenna structure shown in FIG. 1.

FIG. 4 illustrates a diagram showing radiation efficiency measurement of the antenna structure 100 shown in FIG. 1. It can be derived from FIG. 4 that the antenna structure 100 can achieve an acceptable radiation efficiency at effective frequency bands. In detail, when the antenna structure 100 receives/sends wireless signal at frequency from about 880 MHz to about 960 MHz, the radiation efficiency of the antenna structure 100 is greater than −4 dB. When the antenna structure 100 receives/sends wireless signal at frequency from about 1640 MHz to about 2610 MHz, the radiation efficiency of the antenna structure 100 is greater than −2 dB.

Figure 5:
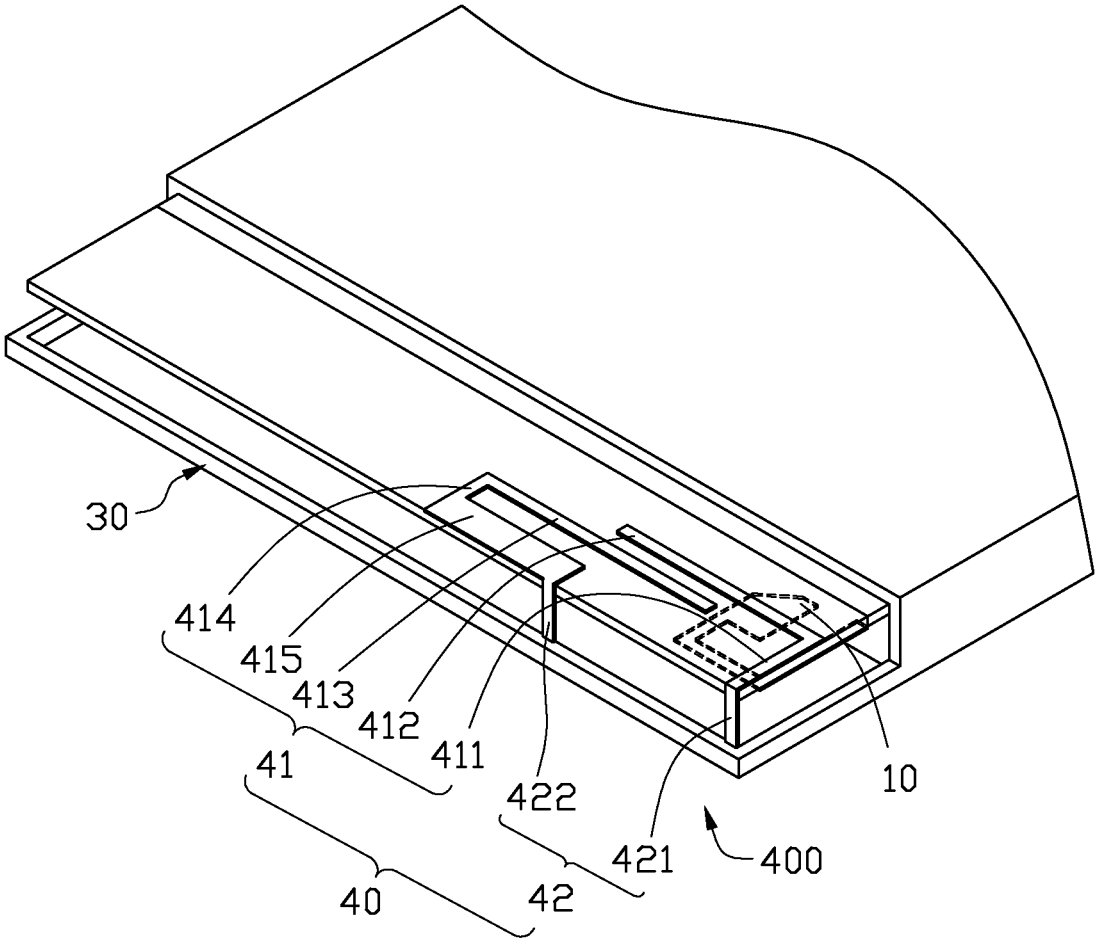
FIG. 5 is a partial isometric view of a second embodiment of a wireless communication device employing an antenna structure.

FIG. 5 is a partial isometric view of a second embodiment of a wireless communication device employing an antenna structure 400. The antenna structure 400 differs from the antenna structure 100 only in that: the antenna structure 400 includes a parasitic antenna 40 which replaces the parasitic antenna 20 of antenna structure 100. In this embodiment, the parasitic antenna 40 includes a resonating portion 41 and a connecting portion 42. The resonating portion 41 includes five radiating arms 411-415. The radiating arm 411 and the radiating arm 412 cooperatively form an L-shape structure. The radiating arm 413 is parallel to and spaced apart from both the radiating arms 411 and 412. The radiating arm 414 is substantially perpendicularly connected between the radiating arm 413 and the radiating arm 415. In one embodiment, the radiating arm 415 is wider than the radiating arm 413. The connecting portion 42 includes two connecting arms 421-422. The connecting arm 421 substantially perpendicularly extends from an end of the radiating arm 411. The connecting arm 422 substantially perpendicularly extends from an end of the radiating arm 411, and is parallel to the connecting arm 421.

Figure 6:
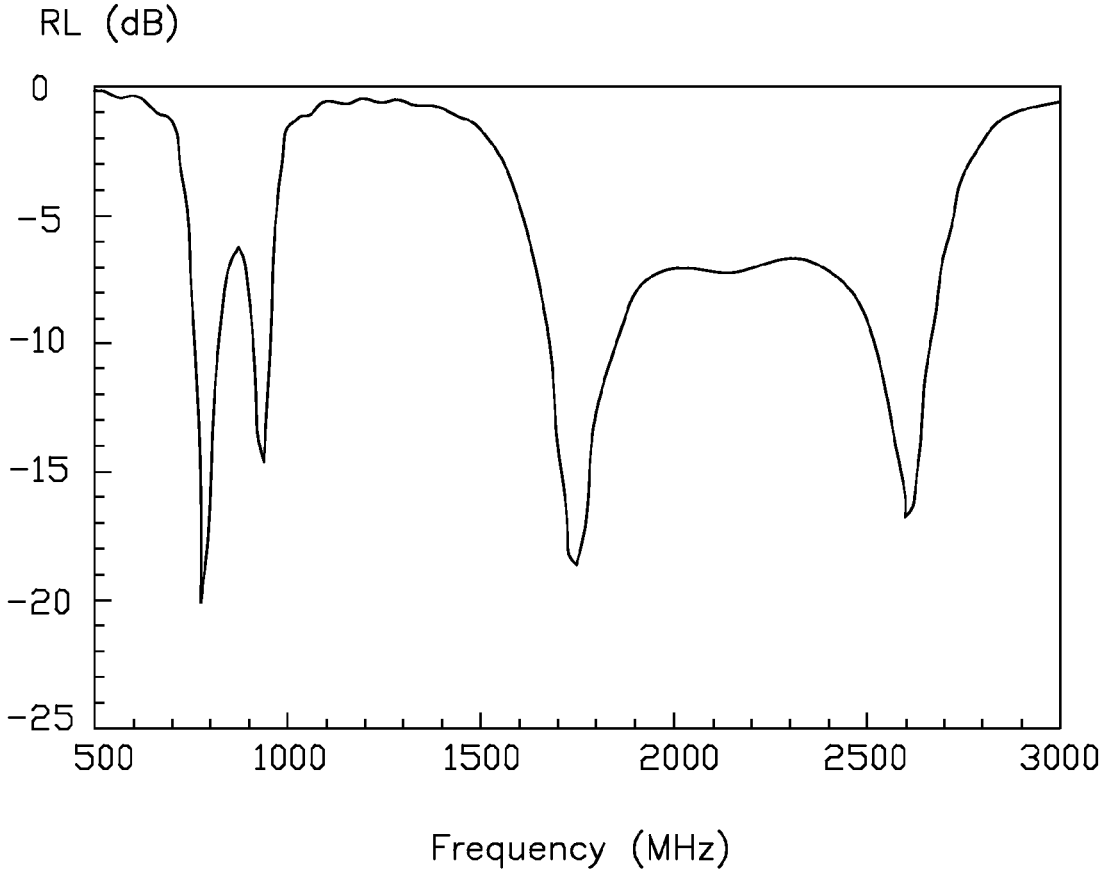
FIG. 6 is a diagram showing RL of the antenna structure shown in FIG. 5.
Figure 7:
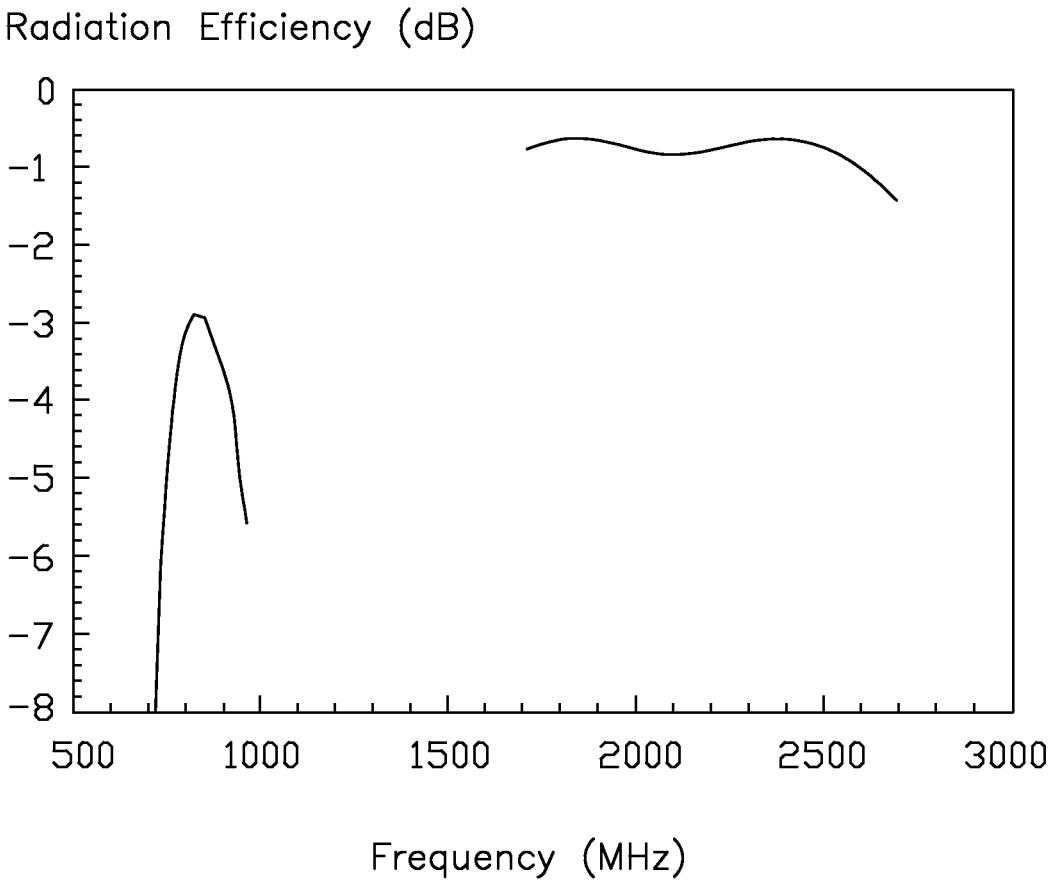
FIG. 7 is a diagram showing frequency efficiency measurement of the antenna structure shown in FIG. 5.

FIG. 6 illustrates a diagram showing RL measurement of the antenna structure 400 shown in FIG. 5. FIG. 7 illustrates a diagram showing radiation efficiency measurement of the antenna structure 400 shown in FIG. 5. As shown in FIG. 6, the RL of the antenna structure 400 is less than −6 dB when the antenna structure 400 receives/sends wireless signals at frequencies from about 700 MHz to about 960 MHz, and from about 1640 MHz to about 2700 MHz, thus the antenna structure 400 has a broad bandwidth at both low-frequency band and high-frequency band are broadened with acceptable radiation efficiency as shown in FIG. 7.

Figure 8:
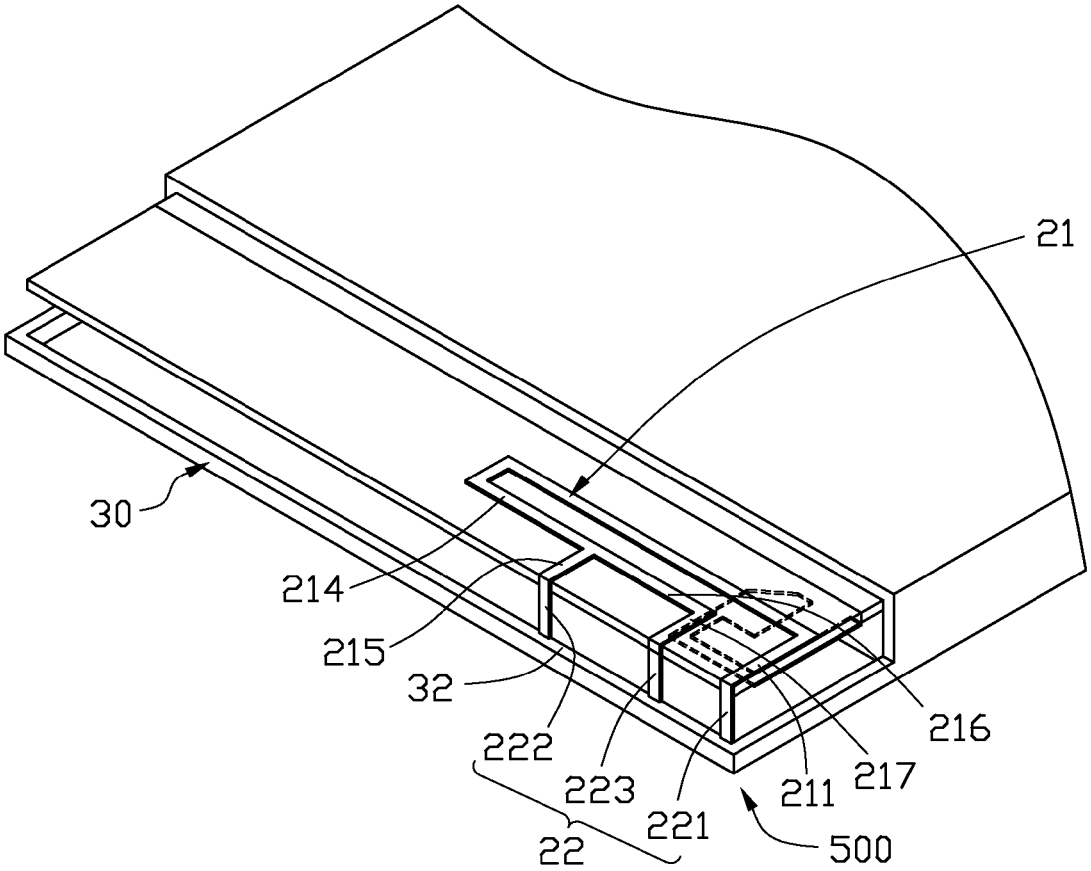
FIG. 8 is a partial isometric view of a third embodiment of a wireless communication device employing an antenna structure.

FIG. 8 is a partial isometric view of a third embodiment of a wireless communication device employing an antenna structure 500. The antenna structure 500 differs from antenna structure 100 only in that, the radiating portion 21 further comprises a radiating arm 216 and a radiating arm 217; the connecting portion 22 further comprises a connecting arm 223. The radiating arm 216 continuously extends from the radiating arm 214. The radiating arm 217 substantially perpendicularly extends from the radiating arm 216, and is positioned between and spaced apart from the radiating arms 215 and 211. The connecting arm 223 is parallel with and spaced apart from the connecting arms 221 and 222, the connecting arm 223 is connected between the radiating arm 217 and the second section 32 of the metal ring 30.

Figure 9:
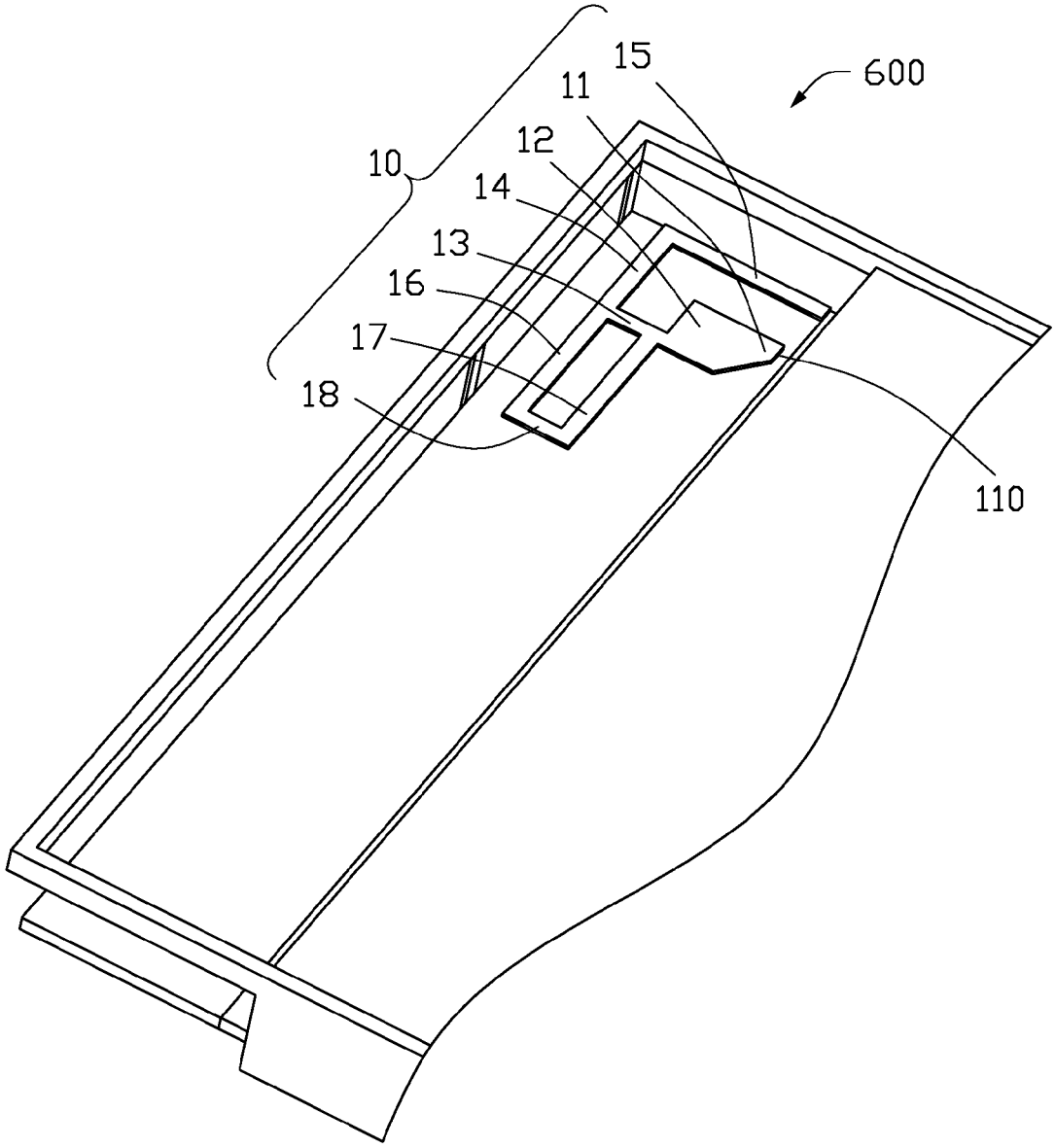
FIG. 9 is a partial isometric view of a fourth embodiment of a wireless communication device employing an antenna structure.

FIG. 9 partial illustrates an isometric view of a fourth embodiment of a wireless communication device employing an antenna structure 600. The antenna structure 600 differs from the antenna structure 100 only in that, the feeding antenna 10 further includes a substantially U-shaped structure connected to two ends of the third strip 13. In particular, the feeding antenna 10 further comprises a sixth strip 16, a seventh strip 17 parallel to the sixth strip 16, and an eighth strip 18 connected between the sixth and seventh strips 16 and 17. The sixth strip 16 continuously extends from the fourth strip 14 opposite the fifth strip 15. The eighth strip 18 is parallel to the fifth strip 15. One end of the seventh strip 17 opposite the eighth strip 18 is coupled to the third strip 13.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wireless communication device comprising:

a substrate comprises a first surface and a second surface opposite the first surface;

an antenna structure comprising:

a feeding antenna having a feeding point configured to feed current signal, the feeding antenna positioned on the first surface;

a metal ring positioned apart from the feeding antenna, the metal ring configured to be grounded and resonate with the feeding antenna to generate a first high-frequency resonate mode; and a parasitic antenna coupled to the metal ring and positioned on the second surface, the parasitic antenna configured to resonate with the feeding antenna to generate a second high-frequency resonate mode, and resonate with the metal ring to generate a low-frequency resonate mode;

wherein the parasitic antenna comprises a resonating portion and a connecting portion, the resonating portion is positioned on the second surface of the substrate; the connecting portion is positioned substantially perpendicularly to the second surface, the connecting portion connects the resonating portion with the metal ring.

2. The wireless communication device of claim 1, further comprising a metal cover, wherein the metal ring is one part of the metal cover.

3. The wireless communication device of claim 1, wherein the resonating portion comprises a first radiating arm, a second radiating arm, a third radiating arm, a fourth radiating arm, and a fifth radiating arm all of which are strips and are connected sequentially; the first radiating arm and the second radiating arm cooperatively define a first L-shape structure; the fourth radiating arm and the fifth radiating arm cooperatively define a second L-shape structure; the first L-shape structure and the second L-shape structure are positioned at a same side of the third radiating arm.

4. The wireless communication device of claim 3, wherein the connecting portion comprises a first connecting arm and a second connecting arm, the first connecting arm substantially perpendicularly extends from an end of the first radiating arm; the second connecting arm substantially perpendicularly extends from an end of the fifth radiating arm, and is parallel to the first connecting arm.

5. The wireless communication device of claim 4, wherein the metal ring comprises a first section, a second section, and a third section; the second section continuously extends from the first section, the third section substantially perpendicularly extends from the second section; a junction between the first section and the second section connects to an end of the first connecting arm; a junction between the second section and the third section connects to an end of the second connecting arm.

6. The wireless communication device of claim 5, wherein the resonating portion further comprises a sixth radiating arm and a seventh radiating arm; the sixth radiating arm continuously extends from the fourth radiating arm; the seventh radiating arm substantially perpendicularly extends from the sixth radiating arm, and is positioned between and spaced apart from the fifth radiating arm and the first radiating arm; the connecting portion further comprises a third connecting arm parallel with and spaced apart from the first connecting arm and the second connecting arm, the third connecting arm is connected between the seventh radiating arm and the second section.

7. The wireless communication device of claim 1, wherein the feeding antenna comprises a first strip, a second strip, a third strip, a fourth strip, and a fifth strip all of which are connected sequentially, the first strip is substantially trapezoid-shaped; the second strip is substantially rectangular shaped and continuously extends from the first strip; the third strip substantially perpendicularly extends from one side of the second strip; the fourth strip substantially perpendicularly extends from the third strip; the fourth strip and the fifth strip cooperatively form an L-shape structure, the third strip and the fifth strip are positioned at a same side of the fourth strip; the feeding point is defined at one side of the first strip opposite the second strip.

8. The wireless communication device of claim 7, wherein the feeding antenna further comprises a sixth strip, a seventh strip parallel to the sixth strip, and an eighth strip connected between the sixth and seventh strips; the sixth strip continuously extends from the fourth strip opposite the fifth strip; the eighth strip is parallel to the fifth strip; one end of the seventh strip opposite the eighth strip is coupled to the third strip.

9. The wireless communication device of claim 1, wherein the resonating portion comprises a first radiating arm, a second radiating arm, a third radiating arm, a fourth radiating arm, and a fifth radiating arm; the first radiating arm and the second radiating arm cooperatively form an L-shape structure; the third radiating arm is parallel to and spaced apart from both the second radiating arm and the fifth radiating arm; the fourth radiating arm is substantially perpendicularly connected between the third radiating arm and the fifth radiating arm.

10. An antenna structure comprising:

a feeding antenna having a feeding point configured to feed current signal;

a metal ring positioned apart from the feeding antenna, the metal ring configured to be grounded and resonate with the feeding antenna to generate a first high-frequency resonate mode; and a parasitic antenna coupled to the metal ring and positioned from the feeding antenna, the parasitic antenna configured to resonate with the feeding antenna to generate a second high-frequency resonate mode, and resonate with the metal ring to generate a low-frequency resonate mode;

wherein the parasitic antenna comprises a resonating portion and a connecting portion, the resonating portion is positioned in a first plane; the connecting portion is positioned in a second plane that is substantially perpendicular to the first plane, the connecting portion connects the resonating portion with the metal ring.

11. The antenna structure of claim 10, wherein the resonating portion comprises a first radiating arm, a second radiating arm, a third radiating arm, a fourth radiating arm, and a fifth radiating arm all of which are strips and are connected sequentially; the first radiating arm and the second radiating arm cooperatively define a first L-shape structure; the fourth radiating arm and the fifth radiating arm cooperatively define a second L-shape structure; the first L-shape structure and the second L-shape structure are positioned at a same side of the third radiating arm.

12. The antenna structure of claim 11, wherein the connecting portion comprises a first connecting arm and a second connecting arm, the first connecting arm substantially perpendicularly extends from an end of the first radiating arm; the second connecting arm substantially perpendicularly extends from an end of the fifth radiating arm, and is parallel to the first connecting arm.

13. The antenna structure of claim 12, wherein the metal ring comprises a first section, a second section, and a third section; the second section continuously extends from the first section, the third section substantially perpendicularly extends from the second section; a junction between the first section and the second section connects to an end of the first connecting arm; a junction between the second section and the third section connects to an end of the second connecting arm.

14. The antenna structure of claim 13, wherein the resonating portion further comprises a sixth radiating arm and a seventh radiating arm; the sixth radiating arm continuously extends from the fourth radiating arm; the seventh radiating arm substantially perpendicularly extends from the sixth radiating arm, and is positioned between and spaced apart from the fifth radiating arm and the first radiating arm; the connecting portion further comprises a third connecting arm parallel with and spaced apart from the first connecting arm and the second connecting arm, the third connecting arm is connected between the seventh radiating arm and the second section.

15. The antenna structure of claim 10, wherein the feeding antenna comprises a first strip, a second strip, a third strip, a fourth strip, and a fifth strip all of which are connected sequentially, the first strip is substantially trapezoid-shaped; the second strip is substantially rectangular shaped and continuously extends from the first strip; the third strip substantially perpendicularly extends from one side of the second strip; the fourth strip substantially perpendicularly extends from the third strip; the fourth strip and the fifth strip cooperatively form an L-shape structure, the third strip and the fifth strip are positioned at a same side of the fourth strip; the feeding point is defined at one side of the first strip opposite the second strip.

16. The antenna structure of claim 15, wherein the feeding antenna further comprises a sixth strip, a seventh strip parallel to the sixth strip, and an eighth strip connected between the sixth and seventh strips; the sixth strip continuously extends from the fourth strip opposite the fifth strip; the eighth strip is parallel to the fifth strip; one end of the seventh strip opposite the eighth strip is coupled to the third strip.

17. The antenna structure of claim 10, wherein the resonating portion comprises a first radiating arm, a second radiating arm, a third radiating arm, a fourth radiating arm, and a fifth radiating arm; the first radiating arm and the second radiating arm cooperatively form an L-shape structure; the third radiating arm is parallel to and spaced apart from both the second radiating arm and the fifth radiating arm; the fourth radiating arm is substantially perpendicularly connected between the third radiating arm and the fifth radiating arm.

18. An antenna structure comprising:

a feeding antenna having a feeding point configured to feed current signal;

a metal ring positioned apart from the feeding antenna, the metal ring configured to be grounded and resonate with the feeding antenna to generate a first high-frequency resonate mode; and a parasitic antenna coupled to the metal ring and positioned from the feeding antenna, the parasitic antenna configured to resonate with the feeding antenna to generate a second high-frequency resonate mode, and resonate with the metal ring to generate a low-frequency resonate mode;

wherein the feeding antenna comprises a first strip, a second strip, a third strip, a fourth strip, and a fifth strip all of which are connected sequentially, the first strip is substantially trapezoid-shaped; the second strip is substantially rectangular shaped and continuously extends from the first strip; the third strip substantially perpendicularly extends from one side of the second strip; the fourth strip substantially perpendicularly extends from the third strip; the fourth strip and the fifth strip cooperatively form an L-shape structure, the third strip and the fifth strip are positioned at a same side of the fourth strip; the feeding point is defined at one side of the first strip opposite the second strip.

19. The antenna structure of claim 18, wherein the feeding antenna further comprises a sixth strip, a seventh strip parallel to the sixth strip, and an eighth strip connected between the sixth and seventh strips; the sixth strip continuously extends from the fourth strip opposite the fifth strip; the eighth strip is parallel to the fifth strip; one end of the seventh strip opposite the eighth strip is coupled to the third strip.

* * * * *